United States Patent [19]

Galle

[11] Patent Number: 4,914,433

[45] **Date of Patent: * Apr. 3, 1990**

[54] CONDUCTOR SYSTEM FOR WELL BORE DATA TRANSMISSION

[75] Inventor: Edward M. Galle, Houston, Tex.

[73] Assignee: Hughes Tool Company, Houston, Tex.

[ * ] Notice: The portion of the term of this patent subsequent to Nov. 29, 2005 has been disclaimed.

[21] Appl. No.: 183,572

[22] Filed: Apr. 19, 1988

[51] Int. Cl.[4] ..... G01V 1/00

[52] U.S. Cl. ..... 340/854; 340/853

[58] Field of Search ..... 367/81.82, 911; 340/853, 854, 856, 857, 870.31; 324/323, 251, 345, 346

[56] References Cited

U.S. PATENT DOCUMENTS

| | | | |
|---|---|---|---|
| 2,000,716 | 5/1935 | Polk | 174/151 |
| 2,178,931 | 11/1939 | Crites et al. | 174/151 |
| 2,858,108 | 10/1958 | Wise et al. | 174/151 |
| 3,072,843 | 1/1963 | Clements et al. | 174/151 R |
| 3,217,282 | 2/1963 | Chevalier et al. | 174/151 |
| 3,764,730 | 10/1973 | Malone et al. | 174/151 |
| 3,899,631 | 8/1975 | Clark | 174/151 |
| 4,029,893 | 6/1977 | Roger | 174/151 X |
| 4,095,865 | 6/1978 | Denison et al. | 174/151 |
| 4,445,734 | 5/1984 | Cunningham | 174/151 |
| 4,523,141 | 6/1985 | Thomas et al. | 174/151 |
| 4,557,538 | 12/1985 | Chevalier | 174/151 |
| 4,636,581 | 1/1987 | Roche et al. | 174/152 R |
| 4,788,544 | 11/1988 | Howard | 340/853 |

FOREIGN PATENT DOCUMENTS 0096914 12/1983 European Pat. Off. .

OTHER PUBLICATIONS

Gurley, Steve, Flexible Circuits, Design and Applications Marcel Dekker, Inc. New York 1984.

*Primary Examiner*—Brian S. Steinberger

*Attorney, Agent, or Firm*—Melvin A. Hunn; Robert A. Felsman

[57] ABSTRACT

An improved electrical transmission system for transmitting electrical power and data signals within a well bore having a string of tubular members suspended within it, each tubular member having a receiving end adapted for receiving data signals and a transmitting end for transmitting data signals, said receiving end and transmitting end being electrically coupled by a flexible printed planar conductor of the type having at least one substantially planar conductive band disposed between at least two layers of electrically insulating material.

9 Claims, ~~4~~ 5 Drawing Sheets

CONDUCTOR SYSTEM FOR WELL BORE DATA TRANSMISSION

CROSS REFERENCE TO RELATED APPLICATION

This application has disclosure in common with "Well Bore Data Transmission System", Ser. No. 001286, filed Jan. 8, 1987, belonging to a common assignee.

BACKGROUND OF THE INVENTION

1. Field of the Invention

This invention relates to the transmission of data within a well bore, and is especially useful in transmitting downhole data or measurements while drilling.

2. Description of the Prior Art

In rotary drilling, the rock bit is threaded onto the lower end of a drill string or pipe. The pipe is lowered and rotated, causing the bit to disintegrate geological formations. The bit cuts a bore hole that is larger than the drill pipe, so an annulus is created. Section after section of drill pipe is added to the drill string as new depths are reached.

During drilling, a fluid, often called "mud", is pumped downward through the drill pipe, through the drill bit, and up to the surface through the annulus carrying cuttings from the borehole bottom to the surface.

It is advantageous to detect borehole conditions while drilling. However, much of the desired data must be detected near the bottom of the borehole and is not easily retrieved. An ideal method of data retrieval would not slow down or otherwise hinder ordinary drilling operations, or require excessive personnel or the special involvement of the drilling crew. In addition, data retrieved instantaneously, in "real time", is of greater utility than data retrieved after time delay.

A system for taking measurements while drilling is useful in directional drilling. Directional drilling is the process of using the drill bit to drill a bore hole in a specific direction to achieve some drilling objective. Measurements concerning the drift angle, the azimuth, and tool face orientation all aid in directional drilling. A measurement while drilling system would replace single shot surveys and wire line steering tools, saving time and cutting drilling costs.

Measurement while drilling systems also yield valuable information about the condition of the drill bit, helping determine when to replace a worn bit, thus avoiding the pulling of "green" bits. Torque on bit measurements are useful in this regard. See T. Bates and C. Martin: "Multisensor Measurements-While-Drilling Tool Improves Drilling Economics", Oil & Gas Journal, Mar. 19, 1984, p. 119–37; and D. Grosso et al.: "Report on MWD Experimental Downhole Sensors", Journal of Petroleum Technology, May 1983, p. 899–907.

Formation evaluation is yet another object of a measurement while drilling system. Gamma ray logs, formation resistivity logs, and formation pressure measurements are helpful in determining the necessity of liners, reducing the risk of blowouts, allowing the safe use of lower mud weights for more rapid drilling, reducing the risks of lost circulation, and reducing the risks of differential sticking. See Bates and Martin article, supra.

Existing measurement while drilling systems are said to improve drilling efficiency, saving in excess of ten percent of the rig time; improve directional control, saving in excess of ten percent of the rig time; allow logging while drilling, saving in excess of five percent of the rig time; and enhance safety, producing indirect benefits. See A. Kamp: "Downhole Telemetry From The User's Point of View", Journal of Petroleum Technology, Oct. 1983, p. 1792–96.

The transmission of subsurface data from subsurface sensors to surface monitoring equipment, while drilling operations continue, has been the object of much inventive effort over the past forty years. One of the earliest descriptions of such a system is found in the July 15, 1935 issue of The Oil Weekly in an article entitled "Electric Logging Experiments Develop Attachments for Use on Rotary Rigs" by J. C. Karcher. In this article, Karcher described a system for transmitting geologic formation resistance data to the surface, while drilling.

A variety of data transmission systems have been proposed or attempted, but the industry leaders in oil and gas technology continue searching for new and improved systems for data transmission. Such attempts and proposals include the transmission of signals through cables in the drill string, or through cables suspended in the bore hole of the drill string; the transmission of signals by electromagnetic waves through the earth; the transmission of signals by acoustic or seismic waves through the drill pipe, the earth, or the mudstream; the transmission of signals by relay stations in the drill pipe, especially using transformer couplings at the pipe connections; the transmission of signals by way of releasing chemical or radioactive tracers in the mudstream; the storing of signals in a downhole recorder, with periodic or continuous retrieval; and the transmission of data signals over pressure pulses in the mudstream. See generally Arps, J.J. and Arps, J.L.: "The Subsurface Telemetry Problem—A Practical Solution" Journal of Petroleum Technology, May 1964, p. 487–93.

Many of these proposed approaches face a multitude of practical problems that foreclose any commercial development. In an article published in August of 1983, "Review of Downhole Measurement-While-Drilling Systems", Society of Petroleum Engineers Paper number 10036, Wilton Gravley reviewed the current state of measurement while drilling technology. In his view, only two approaches are presently commercially viable: telemetry through the drilling fluid by the generation of pressure-wave signals and telemetry through electrical conductors, or "hardwires".

Pressure-wave data signals can be sent through the drilling fluid in two ways: a continuous wave method, or a pulse system.

In a continuous wave telemetry, a continuous pressure wave of fixed frequency is generated by rotating a valve in the mud stream. Data from downhole sensors is encoded on the pressure wave in digital form at the slow rate of 1.5 to 3 binary bits per second. The mud pulse signal loses half its amplitude for every 1,500 to 3,000 feet of depth, depending upon a variety of factors. At the surface, these pulses are detected and decoded. See generally the W. Gravley article, supra, p. 1440.

Data transmission using pulse telemetry operates several times slower than the continuous wave system. In this approach, pressure pulses are generated in the drilling fluid by either restricting the flow with a plunger or by passing small amounts of fluid from the inside of the drill string, through an orifice in the drill string, to the annulus. Pulse telemetry requires about a minute to transmit one information word. See generally the W. Gravley article, supra, p. 1440–41.

Despite the problems associated with drilling fluid telemetry, it has enjoyed some commercial success and promises to improve drilling economics. It has been used to transmit formation data, such as porosity, formation radioactivity, formation pressure, as well as drilling data such as weight on bit, mud temperature, and torque on bit.

Teleco Oilfield Services, Inc., developed the first commercially available mudpulse telemetry system, primarily to provide directional information, but now offers gamma logging as well. See Gravley article, supra; and "New MWD-Gamma System Finds Many Field Applications", by P. Seaton, A. Roberts, and L. Schoonover, Oil & Gas Journal, Feb. 21, 1983, p. 80–84.

A mudpulse transmission system designed by Mobil R. & D. Corporation is described in "Development and Successful Testing of a Continuous-Wave, Logging-While-Drilling Telemetry System", Journal of Petroleum Technology, Oct. 1977, by Patton, B.J. et al. This transmission system has been integrated into a complete measurement while drilling system by The Analyst/Schlumberger.

Exploration Logging, Inc., has a mudpulse measurement while drilling service that is in commercial use that aids in directional drilling, improves drilling efficiency, and enhances safety. Honeybourne, W.: "Future Measurement-While-Drilling Technology Will Focus On Two Levels", Oil & Gas Journal, Mar. 4, 1985, p. 71–75. In addition, the Exlog system can be used to measure gamma ray emissions and formation resistivity while drilling occurs. Honeybourne, W.: "Formation MWD Benefits Evaluation and Efficiency", Oil & Gas Journal, Feb. 25, 1985, p. 83–92.

The chief problems with drilling fluid telemetry include: (1) a slow data transmission rate; (2) high signal attenuation; (3) difficulty in detecting signals over mud pump noise; (4) the inconvenience of interfacing and harmonizing the data telemetry system with the choice of mud pump, and drill bit; (5) telemetry system interference with rig hydraulics; and (6) maintenance requirements. See generally, Hearn, E.: "How Operators Can Improve Performance of Measurement-While-Drilling Systems", Oil & Gas Journal, Oct. 29, 1984, p. 80–84.

The use of electrical conductors in the transmission of subsurface data also presents an array of unique problems. Foremost, is the difficulty of making a reliable electrical connection at each pipe junction.

Exxon Production Research Company developed a hardwire system that avoids the problems associated with making physical electrical connections at threaded pipe junctions. The Exxon telemetry system employs a continuous electrical cable that is suspended in the pipe bore hole.

Such an approach presents still different problems. The chief difficulty with having a continuous conductor within a string of pipe is that the entire conductor must be raised as each new joint of pipe is either added or removed from the drill string, or the conductor itself must be segmented like the joints of pipe in the string.

The Exxon approach is to use a longer, less frequently segmented conductor that is stored down hole in a spool that will yield more cable, or take up more slack, as the situation requires.

However, the Exxon solution requires that the drilling crew perform several operations to ensure that this system functions properly, and it requires some additional time in making trips. This system is adequately described in L. H. Robinson et al.: "Exxon Completes Wire line Drilling Data Telemetry System", Oil & Gas Journal, Apr.14, 1980, p. 137–48.

Shell Development Company has pursued a telemetry system that employs modified drill pipe, having electrical contact rings in the mating faces of each tool joint. A wire runs through the pipe bore, electrically connecting both ends of each pipe. When the pipe string is "made up" of individual joints of pipe at the surface, the contact rings are automatically mated.

While this system will transmit data at rates three orders of magnitude greater than the mud pulse systems, it is not without its own peculiar problems. If standard metallic-based tool joint compound, or "pipe dope", is used, the circuit will be shorted to ground. A special electrically non-conductive tool joint compound is required to prevent this. Also, since the transmission of the signal across each pipe junction depends upon good physical contact between the contact rings, each mating surface must be cleaned with a high pressure water stream before the special "dope" is applied and the joint is made-up.

The Shell system is well described in Denison, E.B.: "Downhole Measurements Through Modified Drill Pipe", Journal Of Pressure Vessel Technology, May 1977, p. 374–79; Denison, E.B.: "Shell's High-Data-Rate Drilling Telemetry System Passes First Test", The Oil & Gas Journal, June 13, 1977, p. 63–66; and Denison, E.B.: "High Data Rate Drilling Telemetry System", Journal of Petroleum Technology, Feb. 1979, p. 155–63.

A search of the prior patent art reveals a history of attempts at substituting a transformer or capacitor coupling in each pipe connection in lieu of the hardwire connection. U.S Pat. No. 2,379,800, Signal Transmission System, by D. G. C. Hare, discloses the use of a transformer coupling at each pipe junction, and was issued in 1945. The principal difficulty with the use of transformers is their high power requirements. U.S. Pat. No. 3,090,031, Signal Transmission System, by A. H. Lord, is addressed to these high power losses, and teaches the placement of an amplifier and a battery in each joint of pipe.

The high power losses at the transformer junction remained a problem, as the life of the battery became a critical consideration. In U.S. Pat. No. 4,215,426, Telemetry and Power Transmission For Enclosed Fluid Systems, by F. Klatt, an acoustic energy conversion unit is employed to convert acoustic energy into electrical power for powering the transformer junction. This approach, however, is not a direct solution to the high power losses at the pipe junction, but rather is an avoidance of the larger problem.

Transformers operate upon Faraday's law of induction. Briefly, Faraday's law states that a time varying magnetic field produces an electromotive force which may establish a current in a suitable closed circuit. Mathematically, Faraday's law is: $emf = -dI/dt$ Volts; where emf is the electromotive force in volts, and $dI/dt$ is the time rate of change of the magnetic flux. The negative sign is an indication that the emf is in such a direction as to produce a current whose flux, if added to the original flux, would reduce the magnitude of the emf. This principal is known as Lenz's Law.

An iron core transformer has two sets of windings wrapped about an iron core. The windings are electrically isolated, but magnetically coupled. Current flowing through one set of windings produces a magnetic flux that flows through the iron core and induces an emf in the second windings resulting in the flow of current in the second windings.

The iron core itself can be analyzed as a magnetic circuit, in a manner similar to DC electrical circuit analysis. Some important differences exist however, including the often nonlinear nature of ferromagnetic materials.

Briefly, magnetic materials have a reluctance to the flow of magnetic flux which is analogous to the resistance materials have to the flow of electric currents. Reluctance is a function of the length of a material, L, its cross section, S, and its permeability U. Mathematically, Reluctance $=L/(U * S)$, ignoring the nonlinear nature of ferromagnetic materials.

Any air gaps that exist in the transformer's iron core present a great impediment to the flow of magnetic flux. This is so because iron has a permeability that exceeds that of air by a factor of roughly four thousand. Consequently, a great deal of energy is expended in relatively small air gaps in a transformer's iron core. See generally, HAYT: Engineering Electro-Magnetics, McGraw Hill, 1974 Third Edition, p. 305–312.

The transformer couplings revealed in the abovementioned patents operate as iron core transformers with two air gaps. The air gaps exist because the pipe sections must be severable.

Attempts continue to further refine the transformer coupling, so that it might become practical. In U.S. Pat. No. 4,605,268, Transformer Cable Connector, by R. Meador, the idea of using a transformer coupling is further refined. Here the inventor proposes the use of closely aligned small toroidal coils to transmit data across a pipe junction.

To date none of the past efforts have yet achieved a commercially successful hardwire data transmission system for use in a well bore.

One long standing problem in the transmission of well bore data has been the electrical coupling of the receiving end and the transmitting end of each tubular member.

The Shell Oil Company telemetry system comprises a modified tubular member, having electrical contact rings in the mating surfaces of each tool joint. The contact rings in each tubular member are electrically coupled by an insulated electrical conductor extending between each contact ring. The insulated electrical conductor is disposed in a fluid-tight metal conduit to isolate said conductor from the fluid in and around the drill string when the tubular members are connected in a drill string and lowered in a well bore. The Shell Oil Company approach is described and claimed in U.S. Pat. No. 4,095,865, entitled Telemetering Drill String with Piped Electrical Conductor.

A different helical conduit is disclosed in Well Bore Data System, Ser. No. 07/001,286 now U.S. Pat. No. 4,788,544. Said conduit designed to adhere to the bore of each tubular member. Both approaches have several shortcomings.

Since it is difficult to secure the helical conduit to the bore wall of each tubular member, said helical conduit is secured to each tubular member only at the pin and box ends of each tubular member. As the tubular members are manipulated in the well bore, this helical conduit may respond by oscillating like a spring, causing the conduit to rub against the bore wall of the tubular members, which in time may produce a breach in the helical conduit. Drilling fluid will enter such a breach and impair the operation of the data transmission system.

In addition, the helical conduit may impede the use of certain wire line tools, by decreasing the diameter of the bore of each tubular member, or by presenting a possibility of entanglement.

SUMMARY OF THE INVENTION

In the preferred embodiment, an electromagnetic field generating means, such as a coil and ferrite core, is employed to transmit electrical data signals across a threaded junction utilizing a magnetic field. The magnetic field is sensed by the adjacent connected tubular member through a Hall Effect sensor. The Hall Effect sensor produces an electrical signal which corresponds to magnetic field strength. This electrical signal is transmitted via an electrical conductor that preferably runs along the inside of the tubular member to a signal conditioning circuit for producing a uniform pulse corresponding to the electrical signal. This uniform pulse is sent to an electromagnetic field generating means for transmission across the subsequent threaded junction. In this manner, all the tubular members cooperate to transmit the data signals in an efficient manner.

In the preferred embodiment, the electrical conductor that couples the receiving end to the transmitting end of each tubular member is a thin flexible printed planar conductor of the type having at least one substantially planar conductive band disposed between two layers of electrically insulating material. Said conductor is secured to the surface of the pipe bore of each tubular member, and is sufficiently thin to be passed under an o-ring seal into sealed cavities and chambers.

In this configuration the electromagnetic field generating means, Hall Effect sensor, and signal conditioning circuit are electrically coupled through the flexible printed planar conductor, yet remain protected from well bore fluid.

DESCRIPTION OF PREFERRED EMBODIMENT

The preferred data transmission system uses drill pipe with tubular connectors or tool joints that enable the efficient transmission of data from the bottom of a well bore to the surface. The configuration of the connectors will be described initially, followed by a description of the overall system.

Figure 1:
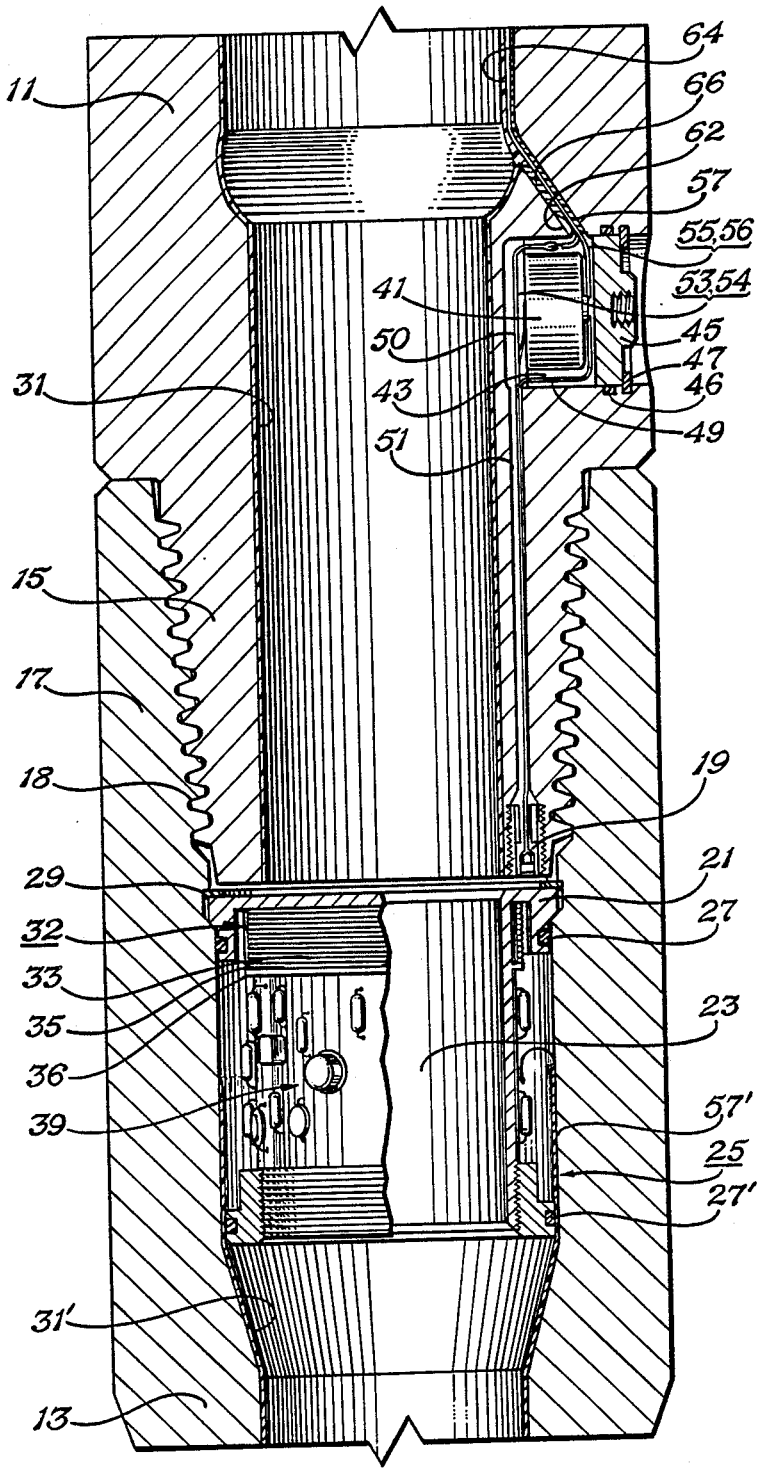
FIG. 1 is a fragmentary longitudinal section of two tubular members connected by a threaded pin and box, exposing the various components that cooperate within the tubular members to transmit data signals across the threaded junction.

In FIG. 1, a longitudinal section of the threaded connection between two tubular members 11, 13 is shown. Pin 15 of tubular member 11 is connected to box 17 of tubular member 13 by threads 18 and is adapted for receiving data signals, while box 17 is adapted for transmitting data signals.

Figures 3, 4:
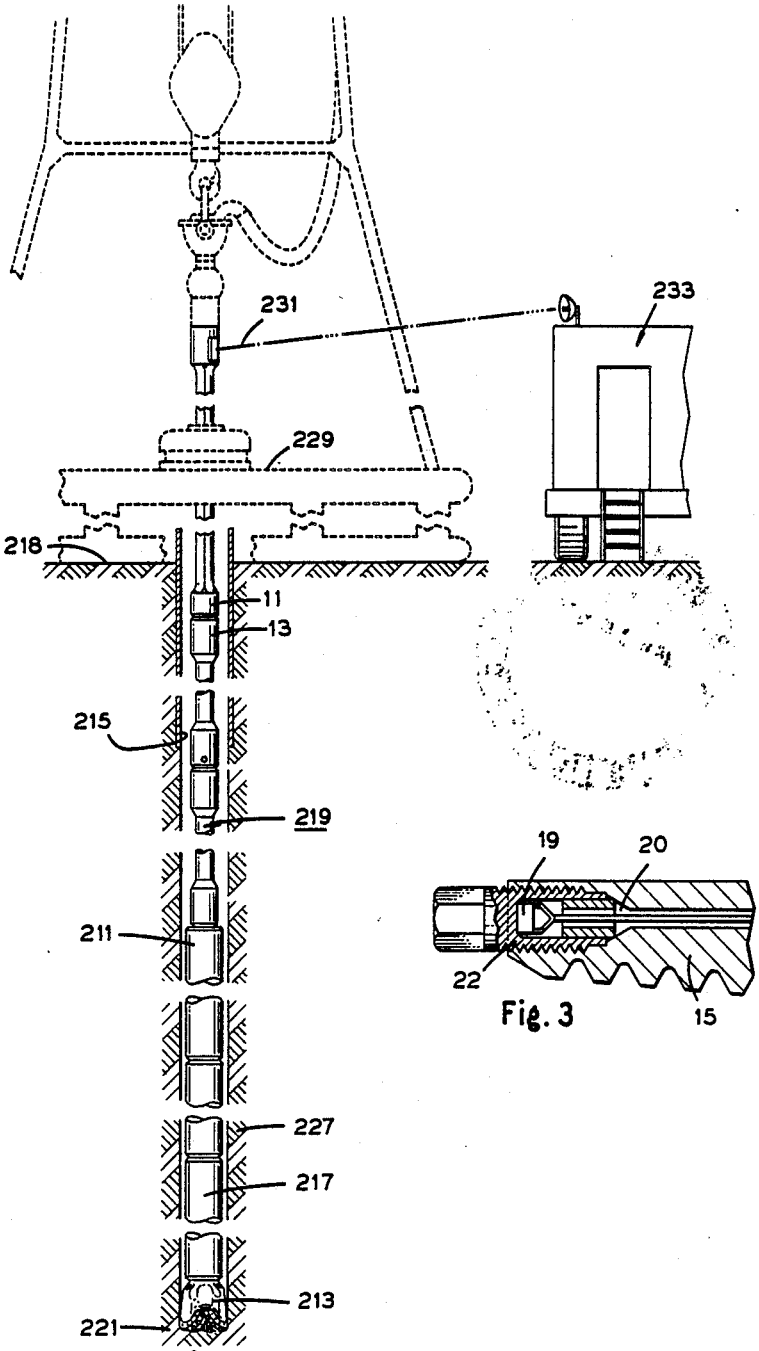
FIG. 3 is a fragmentary longitudinal section of a portion of the pin of a tubular member, demonstrating the preferred method used to place the Hall Effect sensor within the pin.
FIG. 4 is a view of a drilling rig with a drill string composed of tubular members adapted for the transmission of data signals from downhole sensors to surface monitoring equipment.

Hall Effect sensor 19 resides in the nose of pin 15, as is shown in FIG. 3. A cavity 20 is machined into the pin 15, and a threaded sensor holder 22 is screwed into the cavity 20. Thereafter, the protruding portion of the sensor holder 22 is removed by machining.

Returning now to FIG. 1, the box 17 of tubular member 13 is adapted to receive an outer sleeve 21 into which an inner sleeve 23 is inserted. Inner sleeve 23 is constructed of a nonmagnetic, electrically resistive substance, such as "Monel". The outer sleeve 21 is sealed at 27, 27' to tubular member 13 and secured in the box 17 by snap ring 29 and constitute a signal transmission assembly 25. Outer sleeve 21 and inner sleeve 23 are in a hollow cylindrical shape so that the flow of drilling fluids through the bore 31,31' of tubular members 11, 13 is not impeded.

Protected within the inner sleeve 23, from the harsh drilling environment, is an electromagnet 32, in this instance, a coil 33 wrapped about a ferrite core 35 (obscured from view by coil 33), and signal conditioning circuit 39. The coil 33 and core 35 arrangement is held in place by retaining ring 36.

Power is provided to Hall Effect sensor 19, by a lithium battery 41, which resides in battery compartment 43, and is secured by cap 45 sealed at 46, and snap ring 47. Power flows to Hall Effect sensor 19 over conductors 49, 50 contained in a drilled hole 51. The signal conditioning circuit 39 within tubular member 13 is powered by a battery similar to 41 contained at the pin end (not depicted) of tubular member 13.

Two signal wires 53, 54 reside in cavity 51, and conduct signals from the Hall Effect sensor 19. Wires 53, 54 pass through the cavity 51, around the battery 41, and electrically connect to flexible printed circuit 57 for transmission to a signal conditioning circuit and coil and core arrangement in the upper end (not shown) of tubular member 11 identical to that found in the box of tubular member 13.

Two power conductors 55, 56 are electrically coupled to the battery 41 and the signal conditioning circuit at the opposite end (not shown) of tubular member 11 through flexible printed circuit 57. Battery 41 is grounded to tubular member 11, which becomes the return conductor for power conductors 55, 56. Thus, a total of four wires are connected to flexible printed planar conductor 57. Flexible printed planar conductor 57 electrically couples the Hall Effect Sensor 19 and battery 41 to a signal transmission assembly identical to the signal transmission assembly 25 of FIG. 1.

Flexible printed planar conductor 57 is of the type having at least one substantially planar conductive band disposed between at least two layers of electrically insulating material. In the preferred embodiment, the flexible printed planar conductor has an overall thickness of 0.002 to 0.003 inches, a width of approximately one-quarter to one-half inch, and a length roughly equivalent to the length of the particular tubular member, usually approximately thirty feet. Flexible printed circuits are described generally in the book entitled *Flexible Circuit Application & Design Guide*, by S. Gurley, published in May of 1984 by Dekker, and further identified by International Standard Book Number 0-8247-7215-6.

A second drilled hole 62 leads from battery compartment 43 o bore 31. The flexible printed planar conductor 57 is electrically connected to signal wires 53, 54 and power conductors 55, 56 in battery compartment 43. It exits the battery compartment 43 through second drilled hole 62. Second drilled hole 62 is plugged at bore 31 with plug 66 which is composed of Epoxy or similar suitable material. The flexible printed wire 57 runs along bore 31 of tubular member 11 from second drilled hole 62 to the box end of tubular member 11 (not depicted). In the preferred embodiment, flexible printed wire 57 is secured to the bore 31 wall by a thermal set adhesive. This adhesive is cured at the same time the coating 64 is applied to bore 31 of tubular member 11.

Bore 31 is coated with a coating 64 of the type ordinarily used in the industry to coat the bores of tubular members. In the preferred embodiment, said coating 64 is a phenolic coating of the type produced by Baker Hughes Tubular (a subsidiary of Baker Hughes, Inc., a Delaware corporation) further identified as PA700 coating. In the preferred embodiment, coating 64 is at least three to four times as thick as flexible printed planar conductor 57. Flexible printed wire 57 electrically couples the Hall Effect Sensor 19 and battery 41 to a signal transmission assembly identical to the signal transmission assembly 25 of FIG. 1.

Figure 2B:
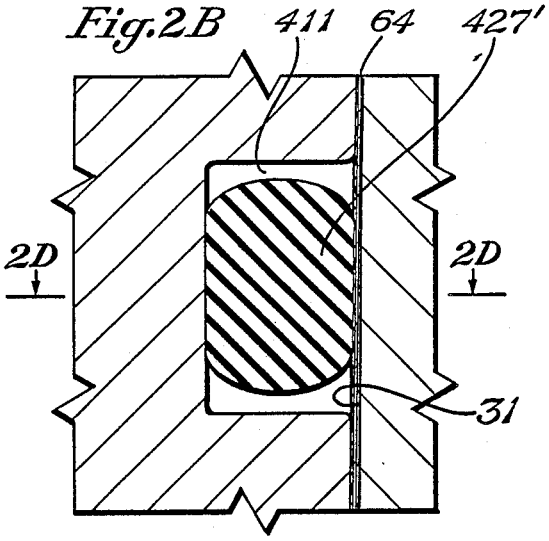
FIG. 2B is an enlargement of a portion of the fragmentary longitudinal section of FIG. 2A.
Figure 2D:
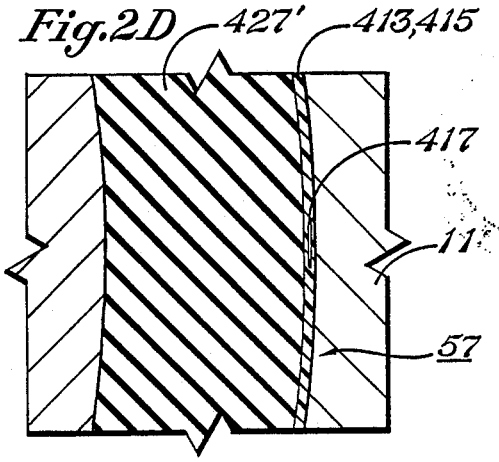
FIG. 2D is a cross section as seen along line 2D—2D of FIG. 2B.
Figure 2C:
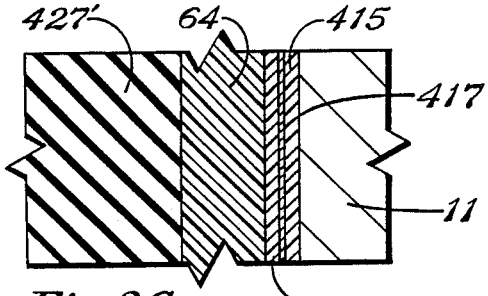
FIG. 2C is an enlargement of a portion of FIG. 2B.
Figure 2A:
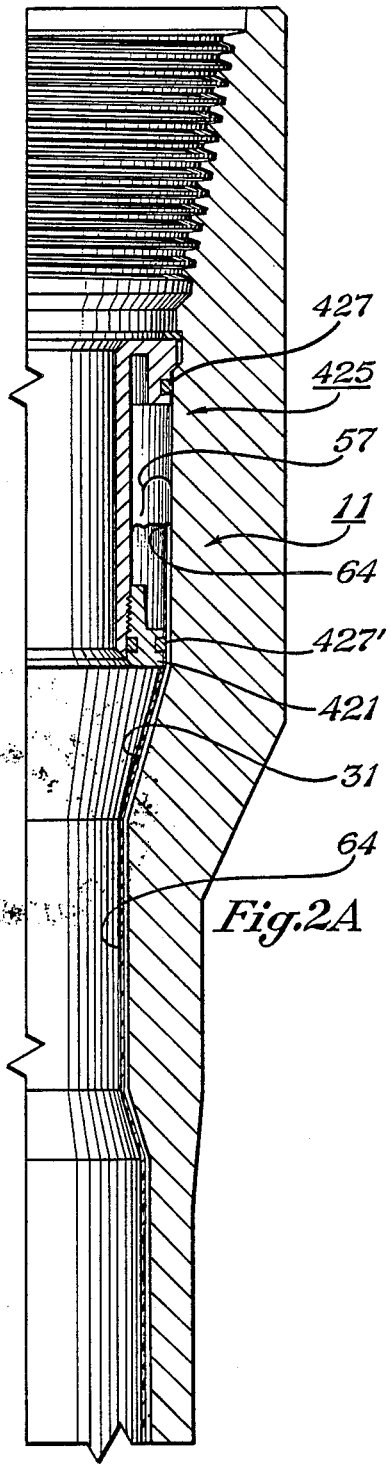
FIG. 2A is a fragmentary longitudinal section of a portion of a tubular member, revealing a conductor system in accordance with the present invention.

FIG. 2A is a fragmentary longitudinal section of a portion of tubular member 11. The box end of tubular member 11 not visible in FIG. 1 is depicted in this view. Signal transmission assembly 425 is identical to signal transmission assembly of FIG. 1. 0-ring 427' seals the outer sleeve 421 at bore 31 which is coated with coating 64. 0-ring 427 seals the outer sleeve 421 at bore 31; coating 64 extends only to the middle of signal transmission assembly 425.

FIG. 2B is an enlargement of a portion of FIG. 2A, specifically an enlargement of 0-ring 427'. 0-ring 427' is disposed in annular groove 411, forming a seal at bore 31 which is coated by coating 64.

FIG. 2C is an enlargement of a portion of FIG. 2B, depicting o-ring 427', coating 64, insulating layers 413 and 415 and conductive bands 417. Conductive bands 417 are disposed between the two insulating layers 413, 415; together, they comprise flexible printed planar conductor 57. This flexible printed planar conductor 57 is secured to tubular member 11 by a thermally set adhesive (not depicted). Coating 64 protects the flexible printed wire from the harsh well bore environment.

FIG. 2D is a cross section as seen along line 2D—2D of FIG. 2B. 0-ring 427' forms a water tight seal that is capable of withstanding high pressure. The effectiveness of this seal is not diminished by the passage of flexible printed planar conductor 57 under sad o-ring 427'. Thus, the signal transmission assembly 425 is both sealed and electrically coupled to electronics carried in other portions of the tubular member.

Figure 6A:
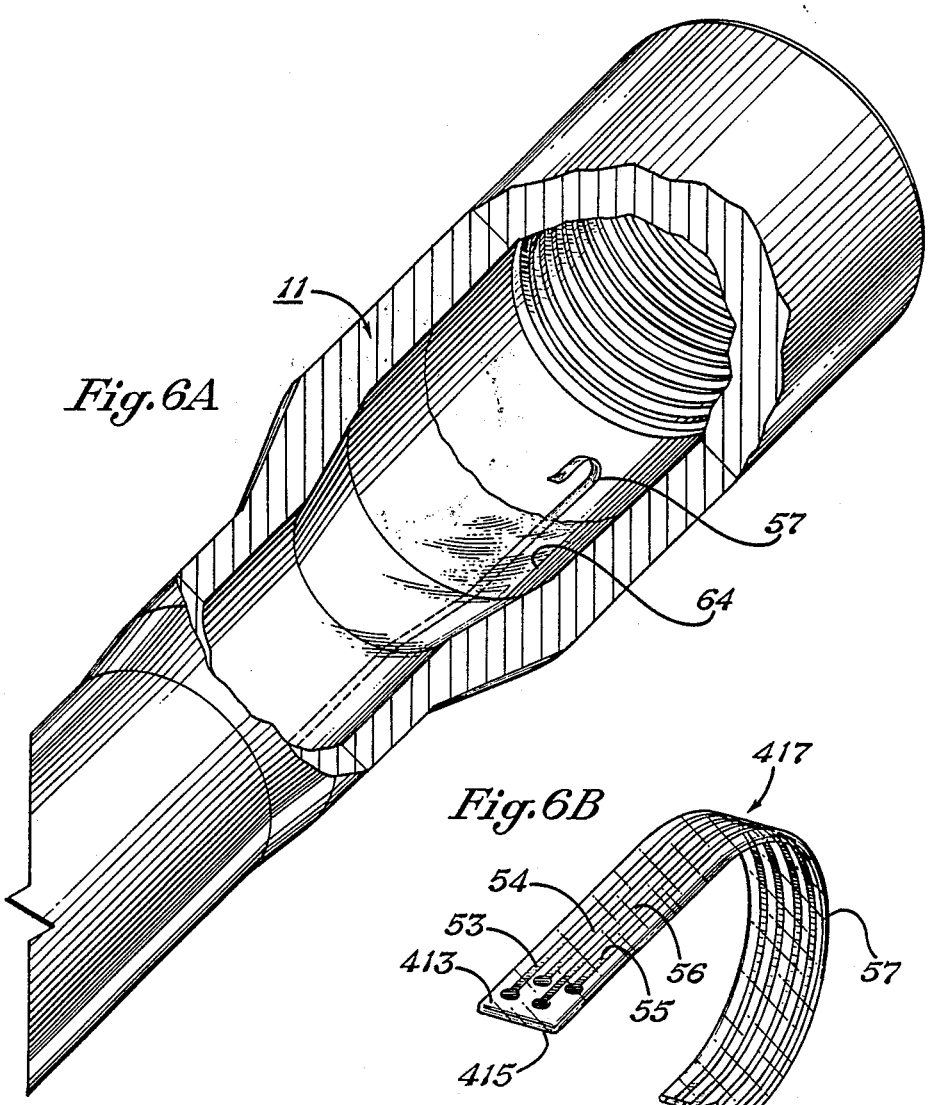
FIG. 6A is a three-quarters fragmentary view of a tubular member with conductor system in accordance with the present invention.
Figure 6B:
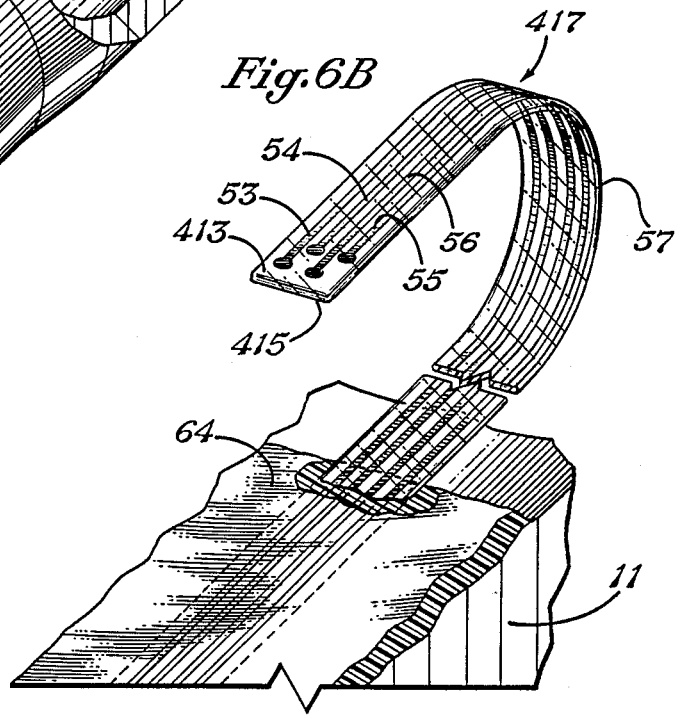
FIG. 6B is an enlarged isometric view of the flexible printed planar conductor depicted in FIG. 6A.

FIG. 6A is a three-quarter fragmentary view of a tubular member with conductor system in accordance with the present invention. The box end of tubular member 11 is shown without the signal transmission assembly 425. Flexible printed planar conductor 57 is secured to tubular member 11 with an adhesive, and coated with coating 64. FIG. 6B is a closer view of the flexible printed wire 57. In the preferred embodiment, conductive bands 417 comprises four conductors 53, 54, 55, 56; said conductors are numbered to correspond to the wires which they are connected, specifically, signal wire 53, 54 and power conductors 55, 56. Conductive bands 417 are disposed between two insulating layers 413, 415.

Figure 5:
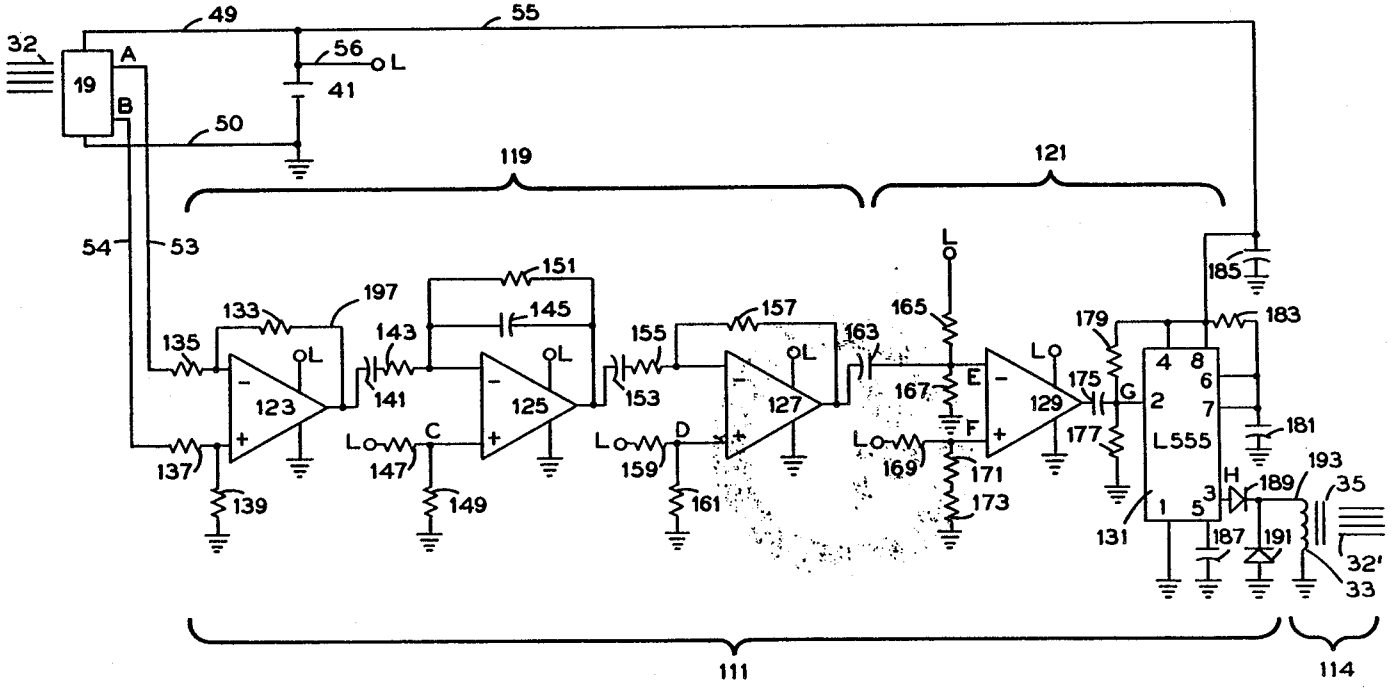
FIG. 5 is a circuit diagram of the signal conditioning means, which is carried within each tubular member.

FIG. 5 is an electrical circuit drawing depicting the preferred signal processing means 111 between Hall Effect sensor 19 and electromagnetic field generating means 114, which in this case is coil 33 and core 35. The signal conditioning means 111 can be subdivided by function into two portions, a signal amplifying means 119 and a pulse generating means 121. Within the signal amplifying means 119, the major components are operational amplifiers 123, 125, and 127. Within the pulse generating means 121, the major components are comparator 129 and multivibrator 131. Various resistors and capacitors are selected to cooperate with these major components to achieve the desired conditioning at each stage.

As shown in FIG. 5, magnetic field 32 exerts a force on Hall Effect sensor 19, and creates a voltage pulse across terminals A and B of Hall Effect sensor 19. Hall Effect sensor 19 has the characteristics of a Hall Effect semiconductor element, which is capable of detecting constant and time-varying magnetic fields. It is distinguishable from sensors such as transformer coils that detect only changes in magnetic flux. Yet another difference is that a coil sensor requires no power to detect time varying fields, while a Hall Effect sensor has power requirements.

Hall Effect sensor 19 has a positive input connected to power conductor 49 and a negative input connected to power conductor 50. The power conductors 49, 50 lead to battery 41.

Operational amplifier 123 is connected to the output terminals A, B of Hall Effect sensor 19 through resistors 135, 137. Resistor 135 is connected betWeen the inverting input of operational amplifier 123 and terminal A through signal conductor 53. Resistor 137 is connected between the noninverting input of operational amplifier 123 and terminal B through signal conductor 54. A resistor 133 is connected between the inverting input and the output of operational amplifier 123. A resistor 139 is connected between the noninverting input of operational amplifier 123 and ground. Operational amplifier 123 is powered through a terminal L which is connected to power conductor 56. Power conductor 56 is connected to the positive terminal of battery 41.

Operational amplifier 123 operates as a differential amplifier. At this stage, the voltage pulse is amplified about threefold. Resistance values for gain resistors 133 and 135 are chosen to set this gain. The resistance values for resistors 137 and 139 are selected to complement the gain resistors 137 and 139.

Operational amplifier 123 is connected to operational amplifier 125 through a capacitor 141 and resistor 143. The amplified voltage is passed through capacitor 141, which blocks any DC component, and obstructs the passage of low frequency components of the signal. Resistor 143 is connected to the inverting input of operational amplifier 125.

A capacitor 14 is connected between the inverting input and the output of operational amplifier 125. The noninverting input or node C of operational amplifier 125 is connected to a resistor 147. Resistor 147 is connected to the terminal L, which leads through conductor 56 to battery 41. A resistor 149 is connected to the noninverting input of operational amplifier 125 and to ground. A resistor 151 is connected in parallel with capacitor 145.

At operational amplifier 125, the signal is further amplified by about twenty fold. Resistor values for resistors 143, 151 are selected to set this gain. Capacitor 145 is provided to reduce the gain of high frequency components of the signal that are above the desired operating frequencies. Resistors 147 and 149 are selected to bias node C at about one-half the battery 41 voltage.

Operational amplifier 125 is connected to operational amplifier 127 through a capacitor 153 and a resistor 155. Resistor 155 leads to the inverting input of operational amplifier 127. A resistor 157 is connected between the inverting input and the output of operational amplifier 127. The noninverting input or node D of operational amplifier 127 is connected through a resistor 159 to the terminal L. Terminal L leads to battery 41 through conductor 56. A resistor 161 is connected between the noninverting input of operational amplifier 127 and ground.

The signal from operational amplifier 125 passes through capacitor 153 which eliminates the DC component and further inhibits the passage of the lower frequency components of the signal. Operational amplifier 127 inverts the signal and provides an amplification of approximately thirty fold, which is set by the selection of resistors 155 and 157. The resistors 159 and 161 are selected to provide a DC level at node D.

Operational amplifier 127 is connected to comparator 129 through a capacitor 163 to eliminate the DC component. The capacitor 163 is connected to the inverting input of comparator 129. Comparator 129 is part of the pulse generating means 121 and is an operational amplifier operated as a comparator. A resistor 165 is connected to the inverting input of comparator 129 and to terminal L. Terminal L leads through conductor 56 to battery 41. A resistor 167 is connected between the inverting input of comparator 129 and ground. The noninverting input of comparator 129 is connected to terminal L through resistor 169. The noninverting input is also connected to ground through series resistors 171,173.

Comparator 129 compares the voltage at the inverting input node E to the voltage at the noninverting input node F. Resistors 165 and 167 bias node E of comparator 129 to one-half of the battery 41 voltage. Resistors 169, 171, and 173 cooperate together to hold node F at a voltage value above onehalf the battery 41 voltage.

When no signal is provided from the output of operational amplifier 127, the voltage at node E is less than the voltage at node F, and the output of comparator 129 is in its ordinary high state (i.e., at supply voltage). The difference in voltage between nodes E and nodes F should be sufficient to prevent noise voltage levels from activating the comparator 129. However, when a signal arrives at node E, the total voltage at node E will exceed the voltage at node F. When this happens, the output of comparator 129 goes low and remains low for as long as a signal is present at node E.

Comparator 129 is connected to multivibrator 131 through capacitor 175. Capacitor 175 is connected to pin 2 of multivibrator 131. Multivibrator 131 is preferably an L555 monostable multivibrator.

A resistor 177 is connected between pin 2 of multivibrator 131 and ground. A resistor 179 is connected between pin 4 and pin 2. A capacitor 181 is connected between ground and pins 6, 7. Capacitor 181 is also connected through a resistor 183 to pin 8. Power is supplied through power conductor 55 to pins 4,8. Conductor 55 leads to the battery 41 as does conductor 56, but is a separate wire from conductor 56. The choice of resistors 177 and 179 serve to bias input pin 2 or node G at a voltage value above one-third of the battery 41.

A capacitor 185 is connected to ground and to conductor 55. Capacitor 185 is an energy storage capacitor and helps to provide power to multivibrator 131 when an output pulse is generated. A capacitor 187 is connected between pin 5 and ground. Pin 1 is grounded. Pins 6, 7 are connected to each other. Pins 4, 8 are also connected to each other. The output pin 3 is connected to a diode 189 and to coil 33 through a conductor 193. A diode 191 is connected between ground and the cathode of diode 189.

The capacitor 175 and resistors 177, 179 provide an RC time constant so that the square pulses at the output of comparator 129 are transformed into spiked trigger pulses. The trigger pulses from comparator 129 are fed into the input pin 2 of multivibrator 131. Thus, multivibrator 131 is sensitive to the "low" outputs of comparator 129. Capacitor 181 and resistor 183 are selected to set the pulse width of the output pulse at output pin 3 or node H. In this embodiment, a pulse width of 100 microseconds is provided.

The multivibrator 131 is sensitive to "low" pulses from the output of comparator 129, but provides a high pulse, close to the value of the battery 41 voltage, as an output. Diodes 189 and 191 are provided to inhibit any ringing, or oscillation encountered when the pulses are sent through conductor 193 to the coil 33. More specifically, diode 191 absorbs the energy generated by the collapse of the magnetic field. At coil 33, a magnetic field 32' is generated for transmission of the data signal across the subsequent junction between tubular members.

As illustrated in FIG. 4, the previously described apparatus is adapted for data transmission in a well bore.

A drill string 211 supports a drill bit 213 within a well bore 215 and includes a tubular member 217 having a sensor package (not shown) to detect downhole conditions. The tubular members 11, 13 shown in FIG. 1 just below the surface 218 are typical for each set of connectors, containing the mechanical and electronic apparatus of FIGS. 1 and 5.

The upper end of tubular member and sensor package 217 is preferably adapted with the same components as tubular member 13, including a coil 33 to generate a magnetic field. The lower end of connector 227 has a Hall Effect sensor, like sensor 19 in the lower end of tubular member 11 in FIG. 1.

Each tubular member 219 in the drill string 211 has one end adapted for receiving data signals and the other end adapted for transmitting data signals.

The tubular members cooperate to transmit data signals up the borehole 215. In this illustration, data is being sensed from the drill bit 213, and from the formation 227, and is being transmitted up the drill string 211 to the drilling rig 229, where it is transmitted by suitable means such as radio waves 231 to surface monitoring and recording equipment 233. Any suitable commercially available radio transmission system may be employed. One type of system that may be used is a PMD "Wireless Link", receiver model R102 and transmitter model T201A.

In operation of the electrical circuitry shown in FIG. 5, DC power from battery 41 is supplied to the Hall Effect sensor 19, operational amplifiers 123, 125, 127, comparator 129, and multivibrator 131. Referring also to FIG. 4, data signals from sensor package 217 cause an electromagnetic field 32 to be generated at each threaded connection of the drill string 211.

In each tubular member, the electromagnetic field 32 causes an output voltage pulse on terminals A, B of Hall Effect sensor 19. The voltage pulse is amplified by the operational amplifiers 123, 125 and 127. The output of comparator 129 will go low on receipt of the pulse, providing a sharp negative trigger pulse. The multivibrator 131 will provide a 100 millisecond pulse on receipt of the trigger pulse from comparator 129. The output of multivibrator 131 passes through coil 33 to generate an electromagnetic field 32' for transmission to the next tubular member.

This invention has many advantages over existing hardwire telemetry systems. A continuous stream of data signal pulses, containing information from a large array of downhole sensors can be transmitted to the surface in real time. Such transmission does not require physical contact at the pipe joints, nor does it involve the suspension of any cable downhole. Ordinary drilling operations are not impeded significantly; no special pipe dope is required, and special involvement of the drilling crew is minimized Moreover, the high power losses associated with a transformer coupling at each threaded junction are avoided. Each tubular member has a battery for powering the Hall Effect sensor, and the signal conditioning means; but such battery can operate in excess of a thousand hours due to the overall low power requirements of this invention.

The present invention employs efficient electromagnetic phenomena to transmit data signals across the junction of threaded tubular members. The preferred embodiment employs the Hall Effect, which was discovered in 1879 by Dr. Edwin Hall. Briefly, the Hall Effect is observed when a current carrying conductor is placed in a magnetic field. The component of the magnetic field that is perpendicular to the current exerts a Lorentz force on the current. This force disturbs the current distribution, resulting in a potential difference across the current path. This potential difference is referred to as the Hall voltage.

The basic equation describing the interaction of the magnetic field and the current, resulting in the Hall voltage is:

$$V_H=(R_H/t) * I_c * B * \text{SIN } X, \text{ where:}$$

$I_c$ is the current flowing through the Hall sensor;
B SIN X is the component of the magnetic field that is perpendicular to the current path;
$R_H$ is the Hall coefficient; and t is the thickness of the conductor sheet If the current is held constant, and the other constants are disregarded, the Hall voltage will be directly proportional to the magnetic field strength.

The foremost advantages of using the Hall Effect to transmit data across a pipe junction are the ability to transmit data signals across a threaded junction without making a physical contact, the low power requirements for such transmission, and the resulting increase in battery life.

This invention has several distinct advantages over the mudpulse transmission systems that are commercially available, and which represent the state of the art. Foremost is the fact that this invention can transmit data at two to three orders of magnitude faster than the mudpulse systems. This speed is accomplished without any interference with ordinary drilling operations. Moreover, the signal suffers no overall attenuation since it is regenerated in each tubular member.

The conductor system for well bore data transmission has a number of advantages over prior art conductor systems.

First, helical conduits for wiring are not required in the present system. Thus, the hazards of mechanical failures in such conduit systems are altogether avoided.

Second, the flexible printed planar conductor of the present system does not appreciably diminish the diameter of the pipe bore.

Third, the present conductor system presents no possibility of entanglement for wire line tools.

Fourth, the present conductor system is designed to pass under seals, including 0-rings, allowing for the electrical coupling of physically separated, sealed electronics chambers or cavities. Thus, the electrical coupling is accomplished with no risk of breach in the seal, and the various electronic components remain protected from well bore fluids.

I claim:

1. An improved electrical transmission system for use in a fluid filled well bore, comprising in combination:

a tubular member with threaded ends for connection in a drill string in a wellbore, having a transmitting end adapted for transmitting data signals, and a receiving end adapted for receiving data signals;

a partition releasably carried by said transmitting end of said tubular member for mating with said tubular member;

a compartment bounded in part by said partition and in part by said tubular member;

a transmitter disposed in said compartment of said tubular member;

seal means for sealing said compartment where said partition mates with said tubular member to protect said transmitter from said fluid in said well bore;

a flexible planar conductor having at least one substantially planar conductive band covered by electrically insulating material, said flexible planar conductor extending between said receiving end of said tubular member and said transmitting end of said tubular member, passing between said tubular member and said seal means into said compartment, and electrically coupling said receiving end of said tubular member with said transmitter, wherein said seal means is not disturbed and said transmitter is protected from said fluid in said well bore.

2. An improved electrical transmission system for use in a fluid filled well bore environment, comprising in combination:

a tubular member with threaded ends adapted for connection in a drill string in a well bore having an inner wall defining a central fluid passage, a transmitting end adapted for transmitting data signals, and a receiving end adapted for receiving data signals;

a sleeve carried by said transmitting end of said tubular member for mating with said inner wall of said tubular and forming a compartment bounded in part by said sleeve and in part by said inner wall of said tubular member;

a signal transmitter disposed in said compartment of said tubular member;

a seal means for sealing said compartment where said sleeve mates with said inner wall of said tubular member to protect said signal transmitter from said fluid in said well bore;

a flexible printed planar conductor of predetermined thickness, having at least one substantially planar conductive band disposed between at least two layers of electrically insulating material, said flexible printed planar conductor being disposed on said inner wall of said tubular member, passing between said seal means and said inner wall of said tubular member into said compartment, and electrically coupling said receiving end of said tubular member with said signal transmitter, wherein said compartment remains sealed, protecting said signal transmitter from said fluid in said well bore; and means for securing said flexible printed planar conductor to said inner wall of said tubular member.

3. An improved electrical transmission system according to claim 2 wherein said sleeve is releasably carried by said tubular member.

4. An improved electrical transmission system according to claim 2 wherein the seal means comprises:

a plurality of spaced apart annular grooves disposed on said sleeve where it abuts said inner wall of said tubular member; and a plurality of o-rings one disposed in each of said annular grooves, sealingly engaging said inner wall of said tubular member and sealing said compartment from said well bore environment, wherein said flexible printed planar conductor passes between at least one of said plurality of o-rings and said inner wall of said tubular member.

5. An improved electrical transmission system according to claim 2 further comprising:

coating means for coating said central passage of said tubular member, wherein said flexible printed planar conductor is disposed between said inner wall of said tubular member and said coating means.

6. An improved data transmission system for use in a well bore, comprising in combination:

a tubular member with threaded ends adapted for connection in a drill string in a well bore having an inner wall defining a central fluid passage, a receiving end adapted for receiving data signals, and a transmitting end adapted for transmitting data signals;

a Hall Effect sensor means carried by said receiving end of said tubular member for receiving data signals and producing an electrical signal corresponding thereto;

a signal conditioning means carried by said transmitting end of said tubular member for producing a pulse in response to the electrical signal produced by said Hall Effect sensor means;

an electromagnetic field generating means carried by said transmitting end of said tubular member for transmitting data signals;

a sleeve carried by said transmitting end of said tubular member and having first and second mating surface of mating with said inner wall of said tubular member;

a compartment means, formed in part by said sleeve and in part by said tubular member, for housing said signal conditioning means and said electromagnetic field generating means;

first and second seal means for sealing said compartment where said first and second mating surfaces of said sleeve abuts said tubular member;

a flexible printed planar conductor of predetermined thickness having at least one substantially planar conductive band disposed between at least two layers of electrically insulating material, said flexible printed wire being disposed on said inner wall of said tubular member, substantially extending between said transmitting end of said tubular member and said receiving end of said tubular member, passing between said first seal means and said inner wall of said tubular member, and electrically coupling said Hall Effect sensor means, said signal conditioning means, and said electromagnetic field generating means; and a means for securing said flexible printed wire to said inner wall of said tubular member.

7. An improved data electrical transmission system according to claim 6 wherein said sleeve is releasably carried by said tubular member.

8. An improved data transmission system according to claim 6 further comprising:

a battery disposed in said tubular member and electrically coupled to said Hall Effect sensor means, said signal conditioning means, and said electromagnetic field generating means at least in part through said at least one substantially planar conductive band of said flexible printed planar conductor.

9. An improved data transmission system for use in a well bore according to claim 6 further comprising:

a coating means for coating said central passage of said tubular member, wherein said flexible printed planar conductor is disposed between said inner wall of said tubular member and said coating means.

* * * * *